United States Patent [19]

Strumbos

[11] Patent Number: 4,910,428

[45] Date of Patent: Mar. 20, 1990

[54] ELECTRICAL-EROSION RESISTANT ELECTRODE

[76] Inventor: William P. Strumbos, 85 Middleville Rd., Northport, N.Y. 11768

[21] Appl. No.: 846,851

[22] Filed: Apr. 1, 1986

[51] Int. Cl.[4] ..... H01T 13/22

[52] U.S. Cl. ..... 313/141; 313/136

[58] Field of Search ..... 313/136, 141

[56] References Cited

U.S. PATENT DOCUMENTS 3,890,518 6/1975 Tombs ..... 313/141 X 4,539,503 9/1985 Esper et al. ..... 313/141 X

*Primary Examiner*—Kenneth Wieder

[57] ABSTRACT

An electrode for electrical devices subject to electrical erosion effects such as spark erosion. Selected areas of the surface of the firing end of the electrode are provided with a thin coating of electrical-erosion resistant material such that the erosion of the electrode adjacent the coating produces a thin edge which promotes current emission therefrom. Preferably the coating is a layer of aluminum from 0.5 mil to 10 mils in thickness. In further embodiments, the electrode is aluminum or an alloy thereof coated with an unalloyed aluminum. In other embodiments, a longitudinal coaxial hole or one or more slots are provided in the firing end of the electrode.

17 Claims, 1 Drawing Sheet

ELECTRICAL-EROSION RESISTANT ELECTRODE

FIELD OF THE INVENTION

This invention relates to electrical-erosion resistant electrodes and, more particularly, to electrodes for spark plugs, spark igniters, and other electrical devices which electrodes are made of a metal or provided with coating means to counter the effects of electrical erosion due to sparking and the like.

BACKGROUND OF THE INVENTION

This invention has particular application in the reduction in electrical erosion phenomena such as spark erosion of electrodes, especially with regard to the center electrode or center wire of spark plugs and igniters in internal combustion and similar engines. In spark plugs, a gap is provided between the center and ground electrodes for the spark current from the coil to arc across. The shape and material of the electrodes, the gap width, and the temperatures and pressures existing in the combustion chamber determine the voltage that is necessary to produce a spark. The voltage needed for sparking is called the plug's voltage requirement. In general, an electrode which has sharp edges has a lower voltage requirement than one with flat or rounded edges. Sharp edges on the electrodes tend to concentrate ionization and thus lower the voltage requirement. Spark plug electrodes erode away with use; rounding off the edges and causing as much as a 20 to 30 percent increase in the voltage requirements. Erosion also widens the gap between the electrodes. Both of these changes increase the plug's voltage requirements and when the voltage required to produce a spark finally exceeds the output of the ignition system, the plug will no longer fire.

SUMMARY OF THE INVENTION

In a new spark plug, the edges of the end or the firing tip of the centerwire or center electrode are sharp and clean and the sparking efficiency is thus high. In operation, the current flow involved in the production of the spark causes atoms of the metal composing the center electrode to be torn free and to be carried away therefrom. Because electron emmission is promoted by a sharp edge, the effects are greatest at the electrode edges. After extended use, the erosion effects of the sparking rounds off the edges of the center electrode. This reduces its operating efficiency such that 20–30% more voltage can be needed to produce the spark necessary to ignite the fuel-air mixture. In a preferred embodiment of the present invention, the side area or wall of the center electrode is given a thin coating of a spark erosion and corrosion resistant metal. Preferably, the end surface of the center electrode is not coated. Preferably, also, the coating is a 0.5 to 10 mil thickness or layer of pure aluminum. In the operation of a preferred embodiment with an uncoated end surface, spark erosion causes a loss of material in the core region in the uncoated end of the center electrode, but a relatively sharp edge for efficient sparking is provided by the edge of the spark-resistant thin coating on the side wall of the electrode. In an alternate preferred embodiment of the invention , a coaxial hole is provided in the uncoated end of the center electrode and the walls of the hole as well as the side wall of the center electrode can be furnished with a thin erosionresistant coating. In a further preferred embodiment, the end of the center electrode is provided with one or more diametral slots. The walls of the slot as well as the center electrode side wall can be provided with a thin erosion-resistant coating. In a yet further preferred embodiment of the invention, the electrode is made of aluminum or an alloy thereof which may be selectively coated with pure aluminum.

DESCRIPTION OF THE PRIOR ART

Spark plugs were originally furnished with iron or mild steel electrodes, but even in the early days of this century nickel alloy electrodes were recommended. This recommendation was not due to the spark erosion characteristics of the nickel alloys but because the lower coefficient of thermal expansion of those alloys made it less likely that the electrodes would expand enough when heated in operation to crack the insulator. At the present time, nickel-chrome alloys have found favor for use in spark plug electrodes. There is also a more general use of nickel alloy center electrodes having a copper core. Platinum and other precious metals such as gold and alloys thereof are also used for spark plug electrodes. Precious metal and copper-core center electrodes are used mainly to extend the heat range of the spark plug and make it less susceptible to fouling rather than as a palliative reducing spark and electrical erosion.

There does not appear, therefore, to be any teaching in the prior art of an electrode for spark plugs and other electrical devices in which surface areas of the firing tip thereof are coated with a spark resistant or refractory material such that erosion of the uncoated areas of the electrode leaves the edge of the coated area to serve as an electron emitter for efficient spark production. Neither does the prior art provide a teaching of a center electrode whose firing end is either partially or wholly coated with aluminum, nor of a spark plug centerwire made of aluminum or one of its alloys.

The invention will be better understood from the accompanying description with reference to the drawings which show the erosion-resistant electrode according to the invention.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities here shown.

DESCRIPTION OF THE PREFERRED EMBODIMENTS

Figure 1:
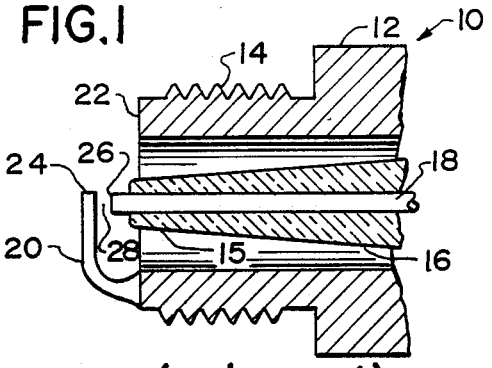
FIG. 1 is a fragmentary side elevation in section of the electrode or firing end of a conventional spark plug.

With reference now to the drawings, the sparking or firing end of a conventional spark plug 10 is shown in FIG. 1. Although only one end portion is shown in FIG. 1, it will be appreciated that the metal shell or body will have the usual hexagon flats at its other end, an upper insulator, sealing means, and a top cap or terminal, and the other appurtenances of a spark plug. The portion of the spark plug shown in FIG. 1 comprises the shell 12 having a threaded outer diameter 14 for installing the spark plug in the cylinder head of an engine (not shown), the electrode end 15 of the insulator 16, the center electrode or centerwire 18, and a ground electrode 20 welded or otherwise fixed on the annular end edge 22 of the spark plug shell. As is customary, the end portion 24 of the ground electrode 20 is positioned with respect to the end 26 of the center electrode 18 such that a spark gap 28 is formed therebetween. At the present time, the firing end portion at least of the center electrode 18 conventionally is made of nickel-chrome and other alloys of nickel. In conventional spark plugs a copper core may be provided to increase the thermal conductivity of the center electrode. Center electrodes of platinum and other precious metals and alloys thereof may be installed in conventional spark plugs for high performance engines. It is known also to employ similar metals and alloys for the ground electrode 20 should operating conditions so dictate. It will be recognized that any of those various constructions of the prior art can be utilized as the substrate for the electrodes embodied in the present invention.

Figure 2:
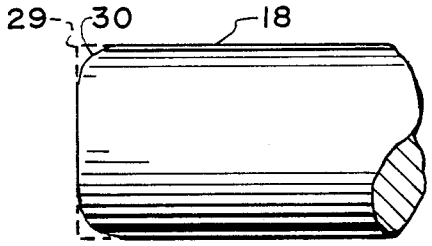
(prior art) FIG. 2
FIG. 2 is the firing tip of the center electrode of the spark plug of FIG. 1 showing how the spark in operation erodes the edges of the tip.

The mechanism involved in an electric spark discharge is not well understood but it is known that the sparking action is promoted if the electrode has sharp edges of a point. As has been mentioned previously, it is believed that the current flow involved in the production of the spark causes atoms of the metal composing the electrode to be torn free and to be projected into the spark gap. This action may be termed "spark erosion". Irrespective of the mechanism involved, it is known that electrical erosion effects are most pronounced at the sharpest edge of the electrode. Thus, as shown in FIG. 2, when the firing end of the electrode 18 is subjected to extended use in operation, the electric current or sparking erodes the sharp edges 29 of the electrode, rounding them off 30 and raising the voltage requirements of the ignition system.

Figure 3:
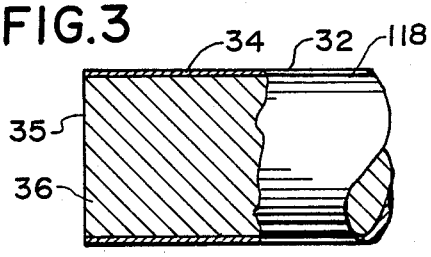
(prior art) FIG. 3
FIG. 3 is a side elevation of the firing tip of the center electrode of a spark plug having the side wall thereof coated in accordance with the invention.

In the present invention as embodied in FIG. 3 the side wall 32 of the electrode 118 is provided with an erosion-resistant coating 34, but the end surface 35 itself o the electrode is uncoated. Although coating 34 can be composed of the following metals: palladium, gold, silver, platinum, copper, nickel, and iron and suitable alloys thereof, or of alloys containing lead, tin, cadmium, or indium; a thin coating of aluminum is preferred. Coating 34 suitably is a 0.5 to 10 mils, preferably 2 mils, thick coating of aluminum applied by a vacuum metallizing process or a vapor diffusion process. The substrate 36 of electrode 118 can be composed of the usual nickel or nickel-chrome alloy but any other electrode metal or alloy having suitable heat and electrical properties that will accept an adherent aluminum coating can be used. If the application permits, the centerwire or electrode can be made of iron or mild steel rather than the more costly nickel or nickel-chrome alloys. Depending on the coating process used, there may be a thin diffusion of a thickness of the base of the aluminum coating into the electrode substrate material such that a thin stratum of aluminum alloys with the electrode material. It will be appreciated that in certain applications the electrode can be aluminum or an alloy of aluminum that is provided selectively with a coating of pure aluminum. It will also be appreciated that the term "erosion-resistant material38 is intended to mean a material in which the erosion caused by an electric current flow or due to a sparking action is reduced with respect to conventional materials under the same operating conditions; the term is not intended to imply that the material is impervious to electrical or spark erosion.

Figure 4:
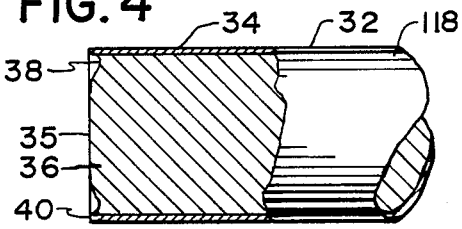
FIG. 4 is the firing tip of the center electrode of FIG. 3 showing the effects of spark erosion.

In operation, as indicated in FIG. 4, the sparking action will erode the more susceptible material of the substrate 36 of electrode 118 such that an annular cavity 38 is formed in the end surface 35 of the electrode. Coating 34 resists spark erosion such that the annular cavity 38 has substantially sharp rim 40 which maintains the sparking efficiency of the electrode.

Figure 5:
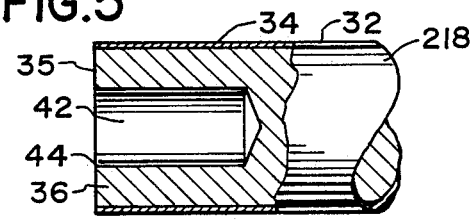
FIGS. 5–7 are side elevations of the firing tip of the center electrode of a spark plug in accordance with further embodiments of the invention.

A further embodiment of the invention is illustrated in FIG. 5. In this embodiment, the electrode 218 is essentially similar to the electrode 118 embodied in FIGS. 3 and 4. Thus, electrode 218 has a substrate 36, an erosion-resistant coating 34 on the side wall 32, and an uncoated end surface 35; it differs from electrode 118 in having a coaxial hole 42 drilled or otherwise formed in the end portion of the electrode. The depth of hole 42 is not critical and may extend a matter of 1 to 4 or 5 mm into the electrode. The materials used and the fabrication techniques can be the same in both embodiments. In operation the rim 44 of axial hole 42 provides an additional sharp edge initially to extend the efficiency of the electrode's spark production.

Figure 6:
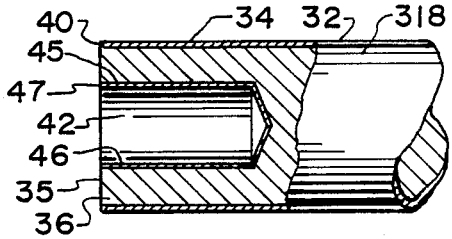

A variation of the FIG. 5 embodiment of the invention is the electrode 318 shown in FIG. 6. Electrode 318 is substantially identical to the FIG. 5 electrode 218 except that the walls 45 of coaxial hole 42 are provided with an erosion-resistant coating 46. Coating 46 can be composed of the same metal or alloy and can be deposited with the same deposition process as coating 34.

In operation, the spark erosion of the more susceptible substrate material of end surface 35 of electrode 318 will form annular cavities (not shown) radially edging on coatings 34 and 46 as has been generally described with respect to the FIGS. 3 and 4 embodiment such that the relatively sharp rims 40 and 47 edging those cavities act to promote sparking efficiency to thereby lower the spark plug voltage requirements.

Figure 7:
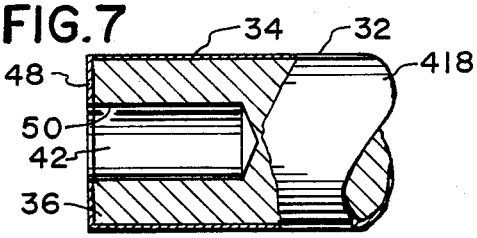

FIG. 7 illustrates a variation of the FIG. 5 embodiment of the invention. As in the FIG. 5 electrode 218, the FIG. 7 electrode 418 has a substrate 36, an erosion-resistant coating 34 on its side wall 32, and a coaxial hole 42 drilled in the end portion of the electrode. However, instead of an uncoated end surface the end surface 35 is provided with an erosion-resistant coating 48. The materials used for the electrode and the erosion-resistant coatings will be the same as those used in the other embodiments. In operation, the area of electrode 418 most susceptible to erosion by the spark will be annular region 50 underlying coating 48 at the edge or rim portion at the opening of the coaxial hole 42.

Figure 8:
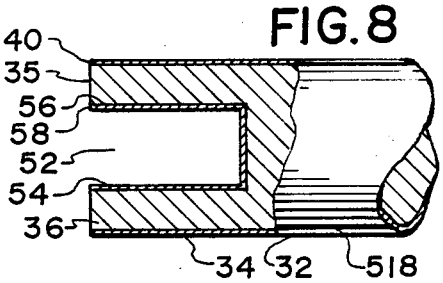
FIG. 8 is a side elevation of the firing tip of the center electrode of a spark plug in accordance with a still further embodiment of the invention.
Figure 10:
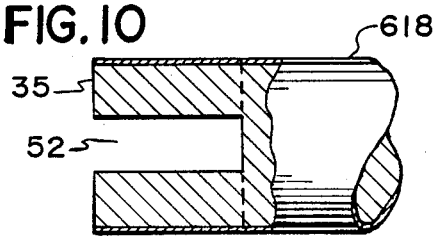
FIG. 10 is a side elevation of the firing tip of the center electrode of a spark plug in accordance with a yet further embodiment of the invention.
Figure 11:
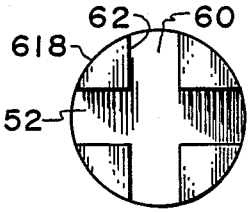
FIG. 11 is an end view of the center electrode of FIG. 10.
Figure 9:
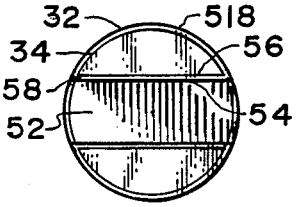
FIG. 9 is an end view of the center electrode of FIG. 8.

A yet further embodiment of the invention is the electrode 518 illustrated in FIGS. 8 and 9. As in the other embodiments of the invention, electrode 518 has a substrate 36 and an erosion-resistant coating 34 on its sidewall 32. Instead of a coaxial hole, electrode 518 has a transverse slot 52 extending longitudinally from its end surface 35 which in this embodiment is not covered with an erosion-resistant coating. The depth of slot 52 is not critical and may extend a matter of 1 to 4 or 5 mm into the electrode. An erosion-resistant coating 54 is applied to both walls 56 of the slot, although coating may be dispensed with as not being cost-effective in certain applications.

In operation, as in the other embodiments of the invention, erosion of the electrode as a result of the spark action occurs in the uncoated surface 35 radially inwardly of the rim 40 at the edge of coating 34 and adjacent to the outer edge 58 of coating 54 (if such is provided) on the walls of the slot 52. Coatings 34 and 54 resist the effects of the sparking action such that the erosion of the electrode substrate adjacent the coatings sharpens the edges 40 and 58 of the coatings to maintain the sparking efficiency of the electrode. As in the FIG. 7 embodiment of the invention, the end surfaces 35 of the FIGS. 8–11 electrodes 518 and 618 can be provided with an erosion-resistant coating and the walls of the slots can be uncovered.

It will be recognized that a second transverse slot normal to the first slot can be provided for the electrode to increase the length of edges available for spark productions. This configuration is shown for electrode 618 shown in FIGS. 10 and 11. Electrode 618 is essentially identical to electrode 518 with the exception that a second transverse slot 60 normal to first slot 52 is provided in the of the electrode. As is the case with slot 52, the walls 62 of slot 60 can be covered with an erosion-resistant coating or as in the case of electrode 518, the end surface 35 can be coated and the walls of the slots uncovered. It is believed that the description given of electrode 518 will provide an understanding of the construction and operation of electrode 618.

Where the material of choice for the electrical-erosion resistant material is aluminum, it will be appreciated that, in applications where thermal expansion characteristics are not a problem, the centerwire or electrode itself can be made out of aluminum. If one of the alloys of aluminum is employed for the electrode material, it can be coated selectively in accordance with the invention with a thin coating of unalloyed aluminum. Aluminum is non-magnetic thus it does not have the problem some magnetizable metals have of attracting solid particles that in spark plugs can bridge the gap and thus short out the plug. The aluminum or aluminum coating can be anodized by commercially acceptable anodizing techniques to harden the surface and to provide abrasion resistance. It has a further advantage in that the anodized surface will absorb dyes to color the surface. Thus, the electrodes can be colored for identification or for aesthetic and other purposes.

In this exposition, the emphasis has been on spark plug electrodes; however, it will be appreciated that the advantages of this invention apply equally to the electrodes of other electrical devices in which electrical erosion such as that due to sparking occurs incidental to their operation.

Although shown and described in what are believed to be the most practical and preferred embodiments, it is apparent that departures form the specific methods and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

Having thus described my invention, what I claim is:

1. An electrode for spark plugs and the like electrical devices subject to electrical erosion effects such as spark erosion comprising: a body having selected areas of the surface thereof covered with a thin coating of electrical-erosion resistant material, said coating in operation resisting erosion resulting from current flow and sparking action, whereby said erosion abrades away said surface adjacent said coating such that the uneroded margin of said thin coating provides an edge which maintains electrical and sparking efficiency.

2. The electrode defined in claim 1 wherein said electrode has a cylindrical body having a firing end with a sparking surface and a side wall and the sparking surface has an edge adjacent said side wall, and wherein said wall is covered with the thin coating of electrical-erosion resistant material.

3. The electrode define in claim 1 wherein said electrode has a cylindrical body having a firing end with a sparking surface and a side wall and the sparking surface has a edge adjacent said side wall, and wherein said sparking surface is covered with the thin coating of electrical-erosion resistant material.

4. The electrode defined in claim 2 wherein a longitudinal coaxial hole opening on the sparking surface is provided in said electrode.

5. The electrode defined in claim 4 wherein the side walls of the coaxial hole is provided with a thin coating of electrical-erosion resistant material.

6. The electrode defined in claim 2 wherein at least a single diametral longitudinally extending slot through the sparking surface is provided in said electrode.

7. The electrode defined in claim 6 wherein a second diametral longitudinally extending slot oriented normal to the first diametral slot is provided through the sparking surface of said electrode.

8. The electrode defined in claim 6 wherein the side walls of said at least single diametral slot are provided with a thin coating of electrical-erosion resistant material.

9. The electrode defined in claim 2 wherein the electrical-erosion resistant material is a thin coating of aluminum.

10. The electrode defined in claim 9 wherein the thin coating is from about 0.5 mil to about 10 mils in thickness.

11. The electrode define in claim 9 where in the thin coating is about 2 mils in thickness.

12. The electrode defined in claim 9 wherein there is a diffusion of a thickness of the base of the aluminum coating into the electrode material such that a thin stratum of the aluminum alloys with said electrode material.

13. An electrode for spark plugs, spark igniters, and like electrical devices subject to electrical erosion phenomena such as spark erosion, said electrode being adapted for sparking operation with an associated electrode of opposite electrical polarity with a spark gap therebetween, said electrode having a cylindrical body provided with a terminal end and a firing end adjacent said spark gap, said firing end having a tip surface with an edge adjacent the side wall of said electrode body, and means for maintaining said edge comprising: a thin coating of electrical-erosion resistant material on said electrode side wall, wherein said coating resists erosion that results in operation from the sparking action whereby said spark erosion abrades away said tip surface adjacent said side wall coating such that the uneroded margin of said thin coating provides an edge which maintains sparking efficiency.

14. The electrode defined in claim 13 wherein said edge is a sharp one.

15. The electrode defined in claim 13 wherein the associated electrode of opposite polarity is provided at least on selected areas thereof with a coating of electrical-erosion resistant material.

16. The electrode defined in claim 9 wherein said coating is anodized.

17. The electrode defined in claim 16 wherein the anodized coating is dyed to color it for aesthetic, identification, and the like purposes.

* * * * *